United States Patent [19]

Morrell

[11] Patent Number: 5,002,285

[45] Date of Patent: Mar. 26, 1991

[54] ARCHERY TARGET

[76] Inventor: Dale A. Morrell, Rte. 2, Box 699, Alma, Ark. 72921

[21] Appl. No.: 550,466

[22] Filed: Jul. 10, 1990

[51] Int. Cl.[5] ..... F41J 3/00

[52] U.S. Cl. ..... 273/408

[58] Field of Search ..... 273/408

[56] References Cited

U.S. PATENT DOCUMENTS

| | | | |
|---|---|---|---|
| 2,305,271 | 12/1942 | Pearson | 273/408 |
| 3,163,418 | 12/1964 | Myers | 273/408 |
| 4,076,246 | 2/1978 | Meyer | 273/408 X |
| 4,244,585 | 1/1981 | Croll | 273/408 |
| 4,643,434 | 2/1987 | Carlin | 273/408 |
| 4,850,596 | 7/1989 | Olund | 273/408 |

*Primary Examiner*—William H. Grieb

*Attorney, Agent, or Firm*—Boyd D. Cox

[57] ABSTRACT

An archery target has a free floating central core formed by a plurality of stacked sheets of a tightly woven nylon material. The sheets are oriented parallel to front and back faces of the target, and serve to absorb arrow impact without being penetrated. The central core is completely surrounded by compressed cotton molt packing disposed within a cardboard frame. The frame, compressed cotton, and central core, are contained within a moisture barrier formed by a polyethylene bag. A plurality of layers of nylon mesh are wrapped around the moisture barrier. The nylon mesh has openings greater than $\frac{1}{4} \times \frac{1}{4}$ inches, such that penetrating arrows are unlikely to hit and break strands of the mesh. The nylon mesh is covered by burlap fabric, upon which various target indicia may be provided. The target has a long service life and allows arrows to be easily removed. Once they strike the target, arrows are maintained in an orientation perpendicular to the front face of the target, minimizing their exposure to subsequent arrows, and thus preventing expensive arrow damage.

13 Claims, 2 Drawing Sheets

ARCHERY TARGET

BACKGROUND OF THE INVENTION

1. Field of the Invention

Archery targets must be designed to allow penetration of arrows in order to stop arrows and maintain them in the position where they strike the target. Repeated penetration of sharp tipped, high velocity arrows causes damage which eventually degrades the target. Because of the expense of target replacement, there is great interest in developing targets having increased service life. The present invention pertains to an improved archery target having a free floating central core which absorbs arrow impacts without penetration, thus increasing the service life of the target.

2. Description of the Prior Art

Various types of archery targets are known in the prior art. A first type of target has a penetrable body formed by a spirally wound coil of grass strands, or a sYnthetic material such as plastic film. The theory of this design is that arrows will penetrate by sliding between the layers of the coil, without severing the strands. Friction of the arrow with the strands slows and retains the arrow. These targets are disadvantageous because they are heavy, the coil layers are actually cut and crushed by arrow impact, and the arrows are difficult to remove from the target. In the case of coiled grass strands, the target degrades rapidly from exposure to moisture and other environmental factors.

A second type of conventional target utilizes one or more layers of a penetrable foam material, such as expanded polYstyrene. Targets of this tYpe are deteriorated rapidly because arrow penetration rips apart the foam. Additionally, frictional engagement of the foam with the arrow makes arrow removal quite difficult.

Accordingly, it can be appreciated that there is a continuing need for and interest in improvements to such archerY targets, and in this respect, the present invention addresses this need and interest.

SUMMARY OF THE INVENTION

In view of the foregoing disadvantages inherent in the known types of archery targets now present in the prior art, the present invention provides an improved archery target. As such, the general purpose of the present invention, which will be described subsequently in greater detail, is to provide a new and improved archery target which has all the advantages of the prior art archery targets and none of the disadvantages.

A representative embodiment of the concepts of the present invention is illustrated in the drawings. Depicted therein is an archery target which has a free floating central core formed by a plurality of stacked sheets of a tightly woven nylon material. The sheets are oriented parallel to front and back faces of the target, and serve to absorb arrow impact without being penetrated. The central core is completely surrounded by compressed cotton molt packing disposed within a cardboard frame. The frame, compressed cotton, and central core, are contained within a moisture barrier formed by a polyethylene bag. A plurality of layers of nylon mesh are wrapped around the moisture barrier. The nylon mesh has openings greater than $\frac{1}{4} \times \frac{1}{4}$ inches, such that penetrating arrows are unlikely to hit and break strands of the mesh. The nylon mesh is covered by burlap fabric, upon which various indicia may be provided. The target has a long service life and allows arrows to be easily removed. Once they strike the target, arrows are maintained in an orientation perpendicular to the front face of the target, minimizing their exposure to subsequent arrows, and thus preventing expensive arrow damage.

There has thus been outlined, rather broadlY, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various waYs. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseologY, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery target which has all the advantages of the prior art archery targets and none of the disadvantages.

It is another object of the present invention to provide a new and improved archery target which may be easily and efficiently manufactured and marketed.

It is a further object of the present invention to provide a new and improved archery target which is of a durable and reliable construction.

An even further object of the present invention is to provide a new and improved archery target which is susceptible of a low cost of manufacture with regard to both materials and labor, and which accordingly is then susceptible of low prices of sale to the consuming public, thereby making such archery targets economically available to the buYing public.

Still yet another object of the present invention is to provide a new and improved archery target which provides in the apparatuses and methods of the prior art some of the advantages thereof, while simultaneously overcoming some of the disadvantages normally associated therewith.

Still another object of the present invention is to provide a new and improved archery target having a free floating central core which absorbs arrow impact without penetration, thus increasing the service life of the target.

Yet another object of the present invention is to provide a new and improved archery target which minimizes frictional engagement with arrows, thus facilitating their removal.

Even still another object of the present invention is to provide a new and improved archery target which maintains arrows in a perpendicular orientation with the front face of the target after they have struck, thus minimizing their exposure to damage from subsequently shot arrows.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanYing drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
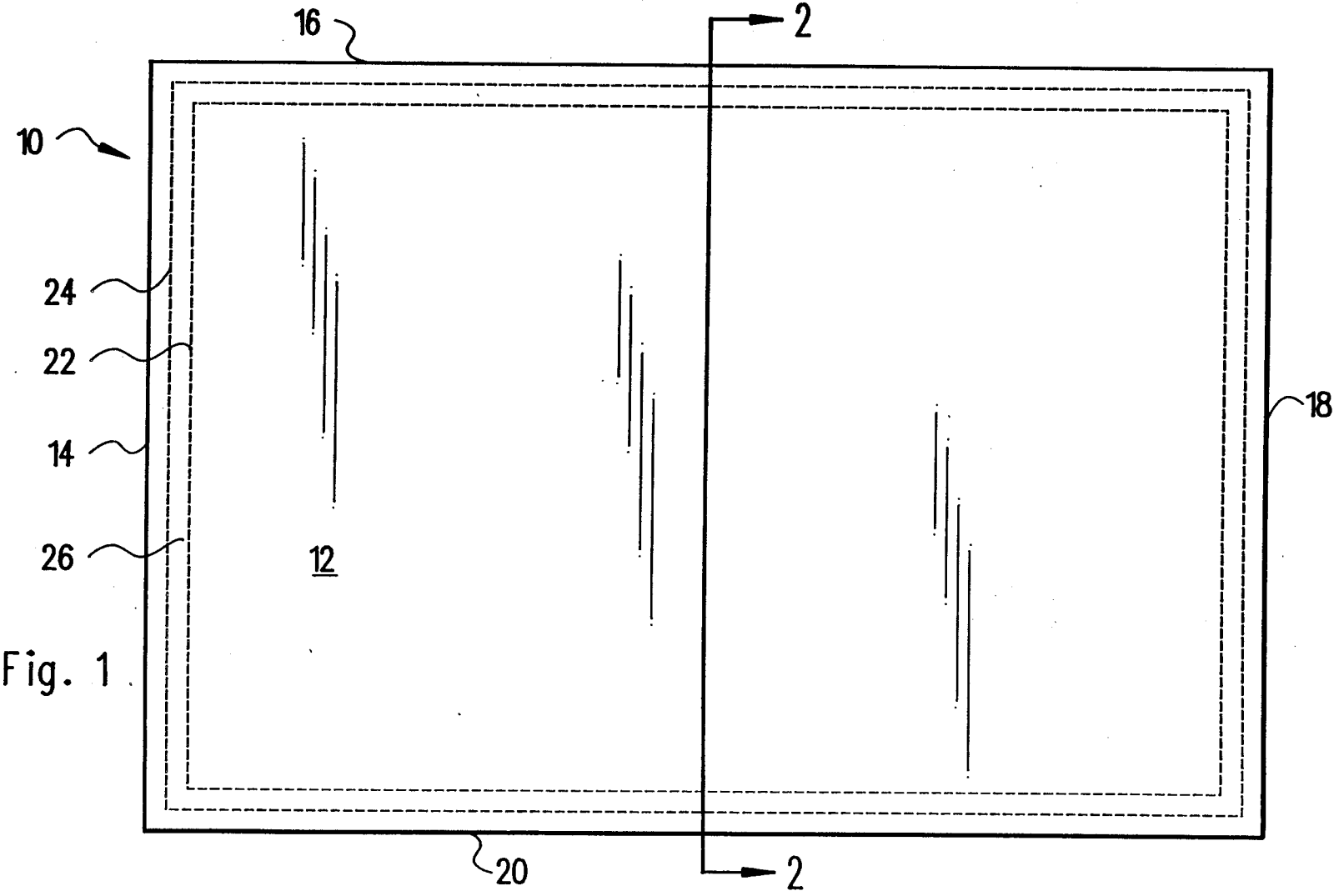
FIG. 1 is a front plan view of an archery target according to the present invention.

With reference now to the drawings, and in particular to FIG. 1 thereof, a new and improved archery target embodYing the principles and concepts of the present invention and generallY designated by the reference numeral 10 will be described.

More specifically, it will be noted that the archery target 10 of the invention has a rectangular shape and includes a front face 12 surrounded by side walls 14, 16, 18 and 20. It should be understood that the target of the present invention is not limited to a rectangular shape, but may also be formed in circular or any other desired shape. The target 10 has a thickness dimension which extends into the plane of the paper, such that the target has a back face (not shown) which extends in spaced, generally parallel relation with the front face 12. A central core 22 is disposed centrally in the interior of the target 10, and also extends generally parallel with the front face 12. The core 22 is disposed between the front face 12 and the back face (not shown) of the target. The target 10 also includes an interior frame 24 which extends within the side walls 14, 16, 18 and 20. The frame 24 surrounds the core 22, but is not secured thereto. The space 26 between the core 22 and the frame 24 is filled with a packing material, as is the space between the core 22 and the front 12 and back faces of the target.

Figure 2:
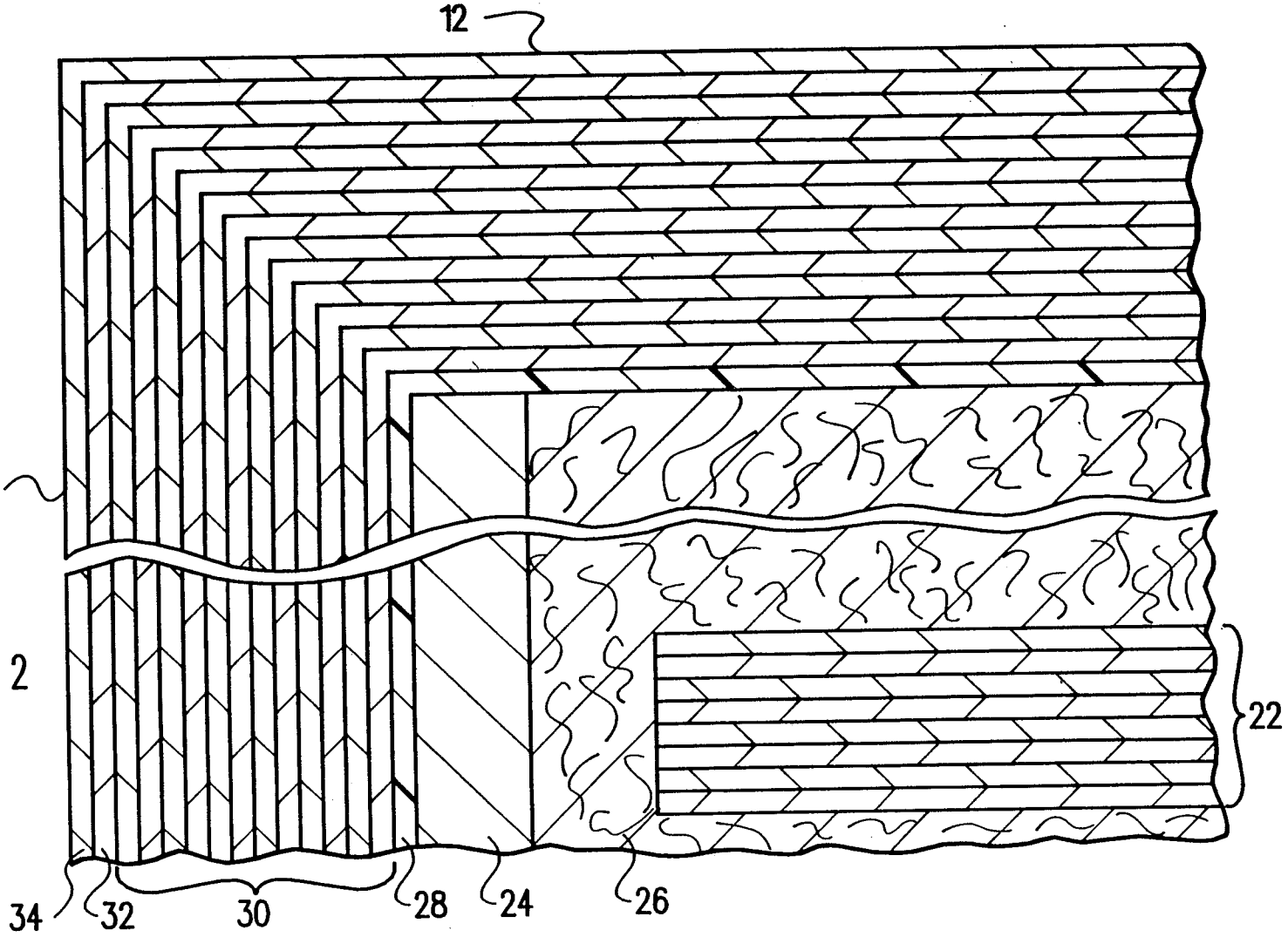
FIG. 2 is a cross sectional view, partially cut away, taken along line 2—2 of FIG. 1.

FIG. 2 is a partially cut away transverse cross sectional view, taken along line 2—2 of FIG. 1. The central core 22 is formed by a plurality of stacked sheets of a penetration resistant material, such as tightly woven nylon. Preferably, eight sheets of fourteen strands per inch OLEFIN (trademark) nylon material are utilized, of the type manufactured by KATY BAG COMPANY of Pearson, Georgia. The nylon sheets forming the core 22 are stacked in alignment, but are not secured together, or to any other component of the target. A compressed packing material 26 surrounds the core 22, such that the core 22 floats freely in the center of the target. The packing material 26 is preferably a compressed cotton molt having less than one and one fourth inch strands of the type available from SMITH COTTON COMPANY of Blytheville, Arkansas. The packing material 26 is surrounded around the sides of the target by a rectangular frame 24, preferably formed from corrugated double wall cardboard, of the tYpe available from UNION CAMP BOX PLANT of Van Buren, Arkansas. The frame 24 does not extend across the target, in a plane parallel with the front face 12, thus making penetration of the frame 24 by an arrow unlikely. The frame 24, packing material 26, and core 22 are all enclosed within a moisture barrier 28, preferably formed by a three mil polyethylene bag of the type available from ACE BAG COMPANY of Newark, New Jersey. A plurality of layers 30 of a mesh material surround the moisture barrier 28. Preferably, twelve layers of a nylon mesh having openings five eighths by three fourths of an inch are employed. A suitable material is available from INTERNET, INC. of Minneapolis, Minnesota. The mesh may be wrapped six times around the top 16 (FIG. 1) and bottom 20 sides and six times around the left 14 and right 18 sides, such that the top 12 and bottom (not shown) faces will each be covered with 12 mesh layers. The outer covering of the target is formed by two layers 32 and 34 of a coarse weave fabric material, preferably ten ounce burlap bags sealed at their openings by staples or hog rings. Suitable burlap bags are available from KATY BAG COMPANY of Pearson, Georgia.

The service life of the target 10 according to the present invention exceeds those of prior art targets due to the floating central core 22. Upon impact of an arrow, the core 22 deflects within the packing material 26, thus resisting penetration. If the core 22 were secured or stretched across the target, striking arrows would penetrate the multiple core layers, thus breaking down the core fibers and wearing out the target. The frame 24 holds the target in shape in a rigid manner during prolonged use. The mesh layers 30 serve to hold the central components of the target together. The openings in the mesh are large enough to pass the arrow tips, such that the arrows are unlikely to break the mesh strands. Additionally, the mesh does not tightly frictionally engage the arrow shafts, thus allowing easy arrow removal. The mesh layers 30, packing 26 and covers 32, 34 provide enough support to maintain arrows in an orientation perpendicular to the front face 12 of the target, to minimize the exposure of arrows in the target to subsequently shot arrows. This is an important feature because inclined arrow shafts in a target present a relatively large surface area to the tips of subsequently shot arrows, and frequently result in expensive arrow replacement. A variety of different scoring or target indicia may, of course, be printed on or attached to the front face 12 of the cover 34, for example concentric rings or the silhouette of various game animals and the vital organs thereof.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An archery target, comprising:

a free floating central core formed by a plurality of stacked sheets of a penetration resistant material;

a compressed packing material surrounding said central core;

a plurality of layers of a mesh material surrounding said packing material, said mesh material having openings dimensioned to freely pass an arrow tip; and an outer cover surrounding said mesh material.

2. The archery target of claim 1, further comprising an open frame surrounding said packing material.

3. The archery target of claim 2, wherein said frame is formed from cardboard.

4. The archery target of claim 2, further comprising a moisture barrier enclosing said frame, said packing material, and said central core.

5. The archery target of claim 4, wherein said moisture barrier is formed from polyethylene.

6. The archery target of claim 1, wherein said penetration resistant material is a tightly woven fabric.

7. The archery target of claim 6, wherein said tightly woven fabric is nylon.

8. The archery target of claim 1, wherein said mesh material is nylon.

9. The archery target of claim 1, wherein said packing material is cotton molt.

10. The archery target of claim 1, wherein said outer cover is formed from a coarse weave fabric.

11. The archery target of claim 10, wherein said coarse weave fabric is burlap.

12. An archery target having a front face, comprising:

a free floating central core formed by a plurality of stacked adjacent sheets of a tightly woven fabric material oriented generally parallel to said front face;

a compressed packing material surrounding said central core;

an open frame surrounding said packing material;

a moisture barrier enclosing said frame, said packing material, and said central core;

a plurality of layers of a mesh material surrounding said moisture barrier, said mesh material having openings dimensioned to freely pass an arrow tip; and at least one layer of a coarse weave fabric material surrounding said mesh material and forming an outer cover.

13. An archery target having a front face, comprising:

a free floating central core formed by a plurality of stacked adjacent sheets of a tightly woven nylon material oriented parallel to said front face;

a compressed cotton molt packing material entirely surrounding said central core;

an open cardboard frame surrounding said packing material;

a polyethylene moisture barrier enclosing said frame, said packing material, and said central core;

a plurality of layers of a nylon mesh material surrounding said moisture barrier, said mesh material having openings at least one fourth inches square; and a plurality of layers of burlap surrounding said mesh material and forming an outer cover.

* * * * *